US008894446B2

(12) United States Patent
Feldner et al.

(10) Patent No.: US 8,894,446 B2
(45) Date of Patent: Nov. 25, 2014

(54) CONTACT FIELD FOR PLUG-IN CONNECTORS

(75) Inventors: Ralf Feldner, Detmold (DE); Thomas Fuhrer, Blomberg (DE)

(73) Assignee: Phoenix Contact GmbH, Blomberg (DE)

( * ) Notice: Subject to any disclaimer, the term of this patent is extended or adjusted under 35 U.S.C. 154(b) by 0 days.

(21) Appl. No.: 13/081,952

(22) Filed: Apr. 7, 2011

(65) Prior Publication Data

US 2011/0256772 A1 Oct. 20, 2011

(30) Foreign Application Priority Data

Apr. 8, 2010 (DE) ..... 10 2010 014 294

(51) Int. Cl.

| | |
|---|---|
| ***H01R 24/00*** | (2011.01) |
| ***H01R 24/64*** | (2011.01) |
| ***H01R 12/72*** | (2011.01) |
| ***H01R 13/6463*** | (2011.01) |

(52) U.S. Cl.

CPC ..... *H01R 13/6463* (2013.01); *H01R 24/64* (2013.01); *H01R 12/727* (2013.01)

USPC ..... 439/676

(58) Field of Classification Search

CPC ..... H01R 24/64; H01R 13/6658; H01R 13/6463; H01R 13/6466; H01R 13/502; H01R 13/6469; H01R 13/6461; H01R 2201/16; H01R 12/62; H01R 12/777; H01R 13/6474; H01R 13/6315; H01R 13/6587; H01R 12/526; H01R 12/592; H01R 12/707; H01R 12/712

USPC ..... 439/676, 79, 941, 540.1, 541.5, 60, 70, 439/329, 326, 876, 76.1, 865, 885, 924.1, 439/924.2, 289, 581, 459, 862, 188, 189, 439/78, 404, 626

See application file for complete search history.

(56) References Cited

U.S. PATENT DOCUMENTS

| | | | | |
|---|---|---|---|---|
| 5,221,210 | A * | 6/1993 | Bormuth et al. | 439/79 |
| 5,226,835 | A | 7/1993 | Baker, III et al. | |
| 5,601,447 | A | 2/1997 | Reed et al. | |
| 5,772,449 | A | 6/1998 | Feldmeier et al. | |
| 6,017,247 | A | 1/2000 | Gwiazdowski | |
| 6,116,943 | A * | 9/2000 | Ferrill et al. | 439/418 |
| 6,270,372 | B1 | 8/2001 | Jenner et al. | |
| 6,290,524 | B1 | 9/2001 | Simmel | |
| 6,428,362 | B1 * | 8/2002 | Phommachanh | 439/676 |

(Continued)

FOREIGN PATENT DOCUMENTS

| | | |
|---|---|---|
| DE | 20105207 | 8/2001 |

*Primary Examiner* — Renee Luebke
*Assistant Examiner* — Harshad Patel
(74) *Attorney, Agent, or Firm* — KPBS LLP

(57) ABSTRACT

The invention relates to a contact field for a plug-in connection for a twisted-pair cabling. The contact field is equipped with several metallic contacts for a connection with a twisted-pair socket, with each metallic contact having a feed line section for a connection with a circuit board. The metallic contacts are formed from contact plates, with at least two of the feed line sections being arranged offset relative to other feed line sections.

8 Claims, 4 Drawing Sheets

(56) References Cited

U.S. PATENT DOCUMENTS

| | | | | |
|---|---|---|---|---|
| 6,439,920 | B1 * | 8/2002 | Chen | 439/418 |
| 6,994,594 | B2 * | 2/2006 | Milner et al. | 439/676 |
| 7,114,985 | B2 * | 10/2006 | Doorhy et al. | 439/404 |
| 7,604,515 | B2 * | 10/2009 | Siemon et al. | 439/676 |
| 7,874,849 | B2 | 1/2011 | Sticker et al. | |
| 2003/0139094 | A1 | 7/2003 | Venditti et al. | |
| 2008/0160837 | A1 * | 7/2008 | Siemon et al. | 439/676 |
| 2008/0311778 | A1 * | 12/2008 | Aekins | 439/344 |

* cited by examiner

FIG. 4A
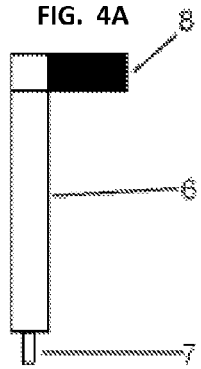
FIG. 4B
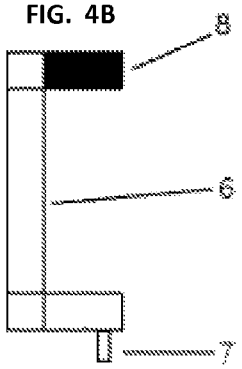
FIG. 4E
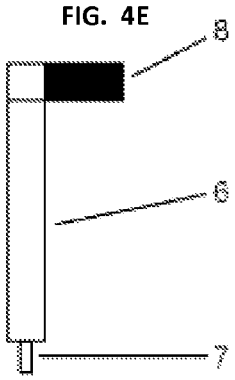
FIG. 4F
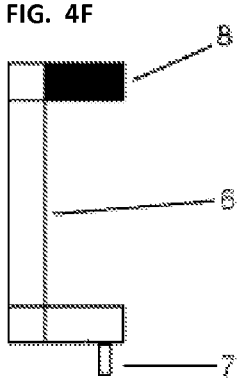
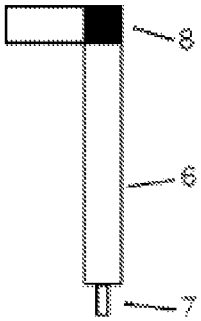
FIG. 4C
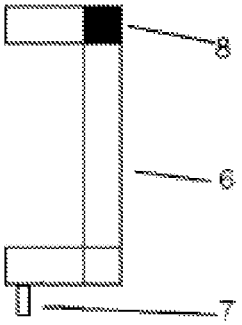
FIG. 4D
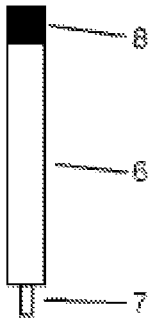
FIG. 4G
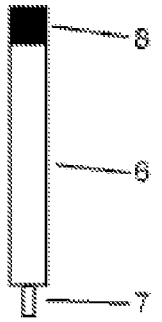
FIG. 4H

CONTACT FIELD FOR PLUG-IN CONNECTORS

RELATED APPLICATION

This application claims priority to German Application No. 102010014294.8, filed on Apr. 8, 2010, the disclosure of which is incorporated herein by reference.

FIELD OF THE INVENTION

The invention relates to a contact field for plug-in connectors

SUMMARY OF THE INVENTION

In network technology, there arises a problem with near-end crosstalk and with reflections at plug-in connectors particularly in the case of increasing transmission speeds.

In particular in the case of the popular twisted-pair cabling which is schematically shown in FIG. 1, there arises a problem with near-end crosstalk between certain pairs of wires.

In the case of a typical twisted-pair cabling, a first pair of wires 11 which is frequently coded blue, blue/white is allocated to contacts 24 and 25 of a rack 5. Likewise, a second pair of wires 12 which is frequently coded orange, orange/white is allocated to contacts 21 and 22 of a rack. A third pair of wires 13 which is frequently coded green, green/white is allocated to contacts 23 and 26 and a fourth pair of wires 14 which is frequently coded brown, brown/white is allocated to contacts 27 and 28 of a rack.

Due to its allocation to contacts 23 and 26 which is located far apart, the third pair of wires 13 in particular will lead to increased near-end crosstalk at the other pairs of wires that is promoted by parallel surfaces of the wire pairs relative to each other.

The contacts known from the state of the art are predominantly made of wire. If wires are also used on the corresponding counterpart of the plug-in connector, contact problems frequently arise since frequently only a point contact will materialize. These contact problems are one of the causes of reflections.

However, attempts at counteracting this effect by means of contact areas has always led to increased near-end crosstalk in the past.

The invention has chosen as its objective the avoidance of at least one of the disadvantages described above in an inventive manner.

SUMMARY OF THE INVENTION

As a solution, the invention proposes a contact field for a plug-in connector for twisted-pair cablings. The contact field is equipped with several metallic contacts for a connection with a twisted-pair socket, with each metallic contact having a feed line section for a connection with a circuit board. The metallic contacts are formed from contact sheet metals, with at least two feed line sections being offset relative to other feed line sections.

In one embodiment of the invention, the contact field is equipped with eight metallic contacts so that a twisted-pair cabling can be provided for common systems of telecommunication, information transmission and computer technology, for example ISDN and Ethernet cabling.

In yet another embodiment of the invention, the third and sixth feed line sections of the feed line segments are arranged offset relative to adjacent feed line sections.

In yet another embodiment of the invention, the contacts and their respective feed line sections are executed in one piece.

In yet another embodiment of the invention, the contact field is an RJ45 contact field.

In yet another embodiment of the invention, the contact field is suitable to meet the specification under CAT6a.

In yet another embodiment of the invention, the contact field is equipped with a housing made of insulating material.

In yet another embodiment of the invention, the contact field is part of a print panel connector.

BRIEF DESCRIPTION OF THE DRAWINGS

In the following, the invention will be explained in detail with references to the figures. They show:

FIG. 4A, illustrates an L-shaped embodiment of contact plates, FIG. 4B illustrates a C-shaped embodiment of contact plates, FIG. 4C illustrates an L-shaped offset arrangement, FIG. 4D illustrates an example of a C-shaped offset arrangement, FIG. 4E illustrates an L-shaped embodiment of contact plates, FIG. 4F illustrates a C-shaped embodiment of contact plates, FIG. 4G illustrates an I-shaped embodiment of contact plates, and FIG., 4H illustrates an I-shaped embodiment of contact plates.

REFERENCE SIGN LIST FOR DRAWINGS

Figure 1:
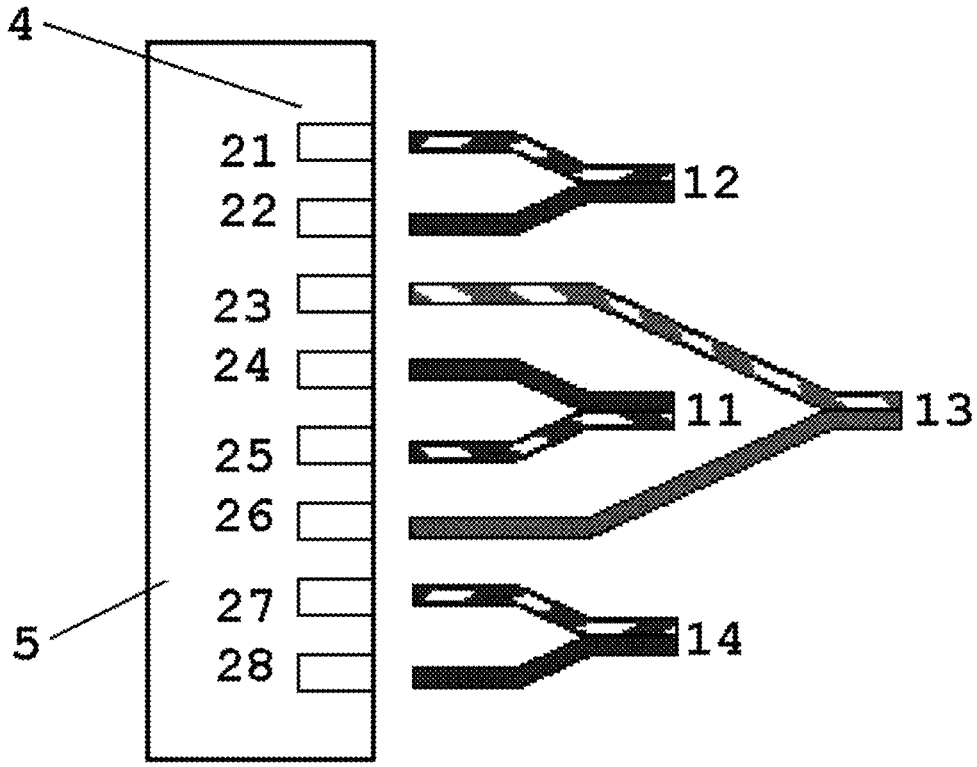
FIG. 1, the schematic allocation of wire pairs of a twisted-pair cabling to the contacts of a twisted-pair plug board, in particular of an RJ45 plug, FIG. 2, a contact field of a plug-in connector according to the invention in a first detail, FIG. 3, a schematic arrangement of a plug-in connector according to the invention in another detail.

1 plug-in connector detail
2 circuit board
4 metallic contacts
5 housing
6 feed line sections
7 circuit board hookup
8 contact area
11 through 14 wire pairs
21 through 28 contacts

DETAILED DESCRIPTION OF THE INVENTION

Figure 2:
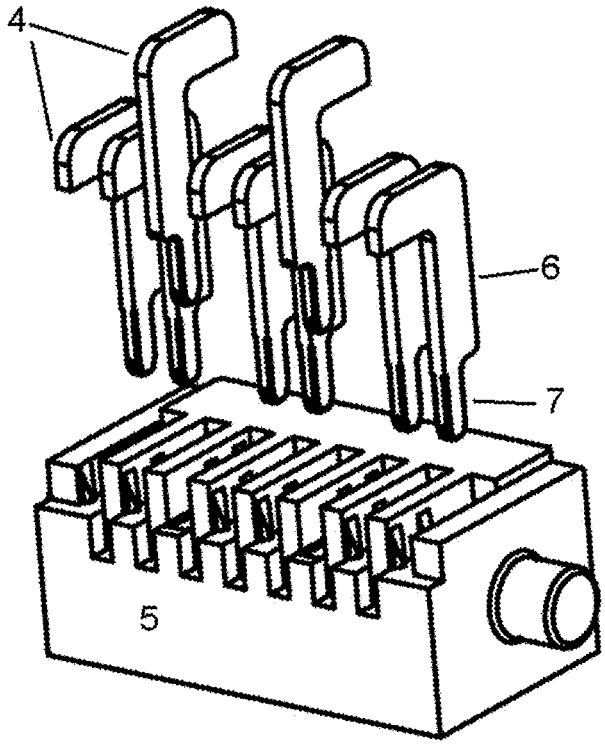

A detail of an embodiment of a plug-in connector according to the invention is shown in FIG. 2.

In this case, the contact field is equipped with several metallic contacts 4 for a connection with a twisted-pair socket, with each metallic contact 4 having a feed line section 6 for a connection with a circuit board 2.

The metallic contacts 4 are formed from contact plates, with at least two of the feed line sections 6 being arranged offset relative to other feed line sections 6.

As can be easily seen in the drawing, the metallic contacts 4 and the respective feed line sections 6 may be formed as part of a plate—i.e. as one piece—so that the contact field can construct the metallic contact 4 with the corresponding counterpart to the plug-in connector on one side and is equipped with the feed line section 6 to a circuit board for a contact with the corresponding wire on the other side.

Figure 3:
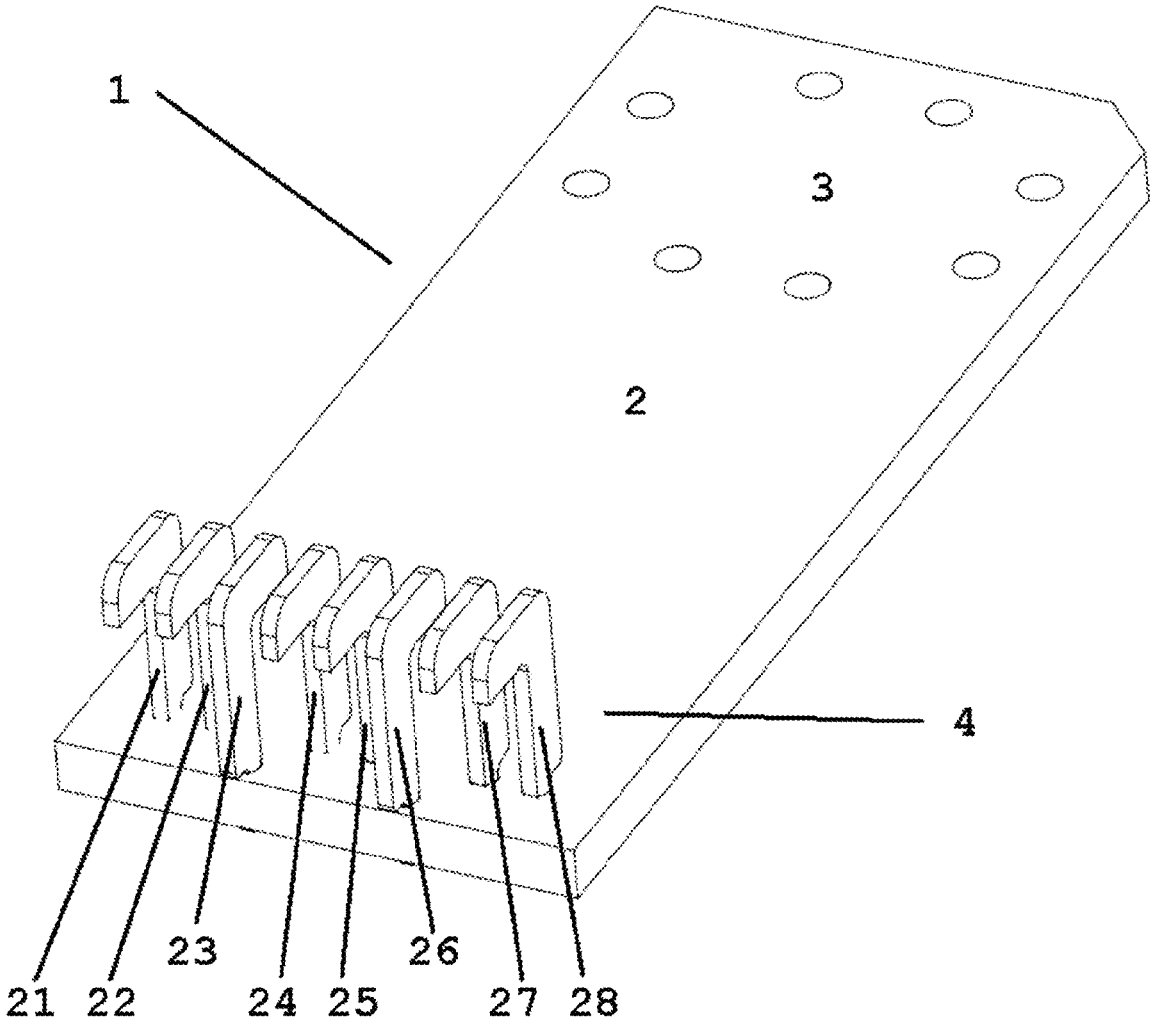

The offset arrangement of feed line sections 6—in FIG. 3, feed line sections 23 and 26 that are arranged offset relative to the other feed line sections 21, 22, 24, 25, 27, 28 in relation to their arrangement on a circuit board 2—achieves that parallel surfaces of allocated adjacent wire pairs 11, 12, 13, 14 are reduced according to FIG. 1.

In a typical twisted-pair cabling, the feed line sections 23 and 26 correspond, as previously shown in FIG. 1, to the third wire pair which tends to strong near-end crosstalk into the other wire pairs.

By avoiding parallel surfaces of this third wire pair 13 relative to the other wire pairs 11, 12, 14 in the area of the feed line sections 6 themselves, the near-end crosstalk will be effectively reduced.

The contact with the circuit board can be realized by means of a circuit board hookup 7, e.g. in the form of a soldering connection—see for example FIG. 4A—or, for surface mounting as it is known from SMD technology, by providing an appropriately bent surface.

Here, too, the parallel surface can be reduced further by appropriately placing the circuit board hookup 7. This can easily be seen in, for example, FIG. 4A.

In FIGS. 4A-4H, various embodiments of contact plates, such as for example, L-shaped contact plates in FIG. 4A, 4C, and 4E, C-shaped contact plates in FIGS. 4B, 4D, and 4F, and I-shaped contact plates in FIGS. 4G and 4H according to the invention are shown.

An L-shaped embodiment of a contact plate 4 is shown schematically in FIG. 4A (the extreme left upper half). The contact area 8 which serves the contact with a socket is located in the upper region, shown in black. Adjoining it is the feed line section 6, followed by a circuit board hookup 7.

A corresponding C-shaped embodiment is represented in FIG. 4B (the left upper middle half). The contact area 8, drawn in black, which serves a contact with a socket is located in the upper area. Adjoining it is the feed line section 6, followed by a circuit board hookup 7.

The offset arrangement of the same embodiment is shown in FIGS. 4C-4D, each case below FIGS. 4A-4B (the two left upper embodiments). As one can clearly see, the sections 6 of each of FIGS. 4A-4B (upper representation) are offset relative to the representation in FIGS. 4C-4D (lower representation). The same also applies to the circuit board hookups 7 that are likewise arranged offset. In this way, both arrangements may be realized by means of one single type of contact plate 4.

However, the invention is not limited thereto.

As one sees in FIGS. 4E-4H (the right half of Illustration 4A-H), varying embodiments of contact plates 4 may be combined in order to achieve an offset arrangement of the feed line sections 6.

An L-shaped embodiment of a contact plate 4 is shown in FIG. 4E (the center right half) in comparison with an I-shaped embodiment in FIG. 4G. Again, the contact areas 8 are drawn in black.

In FIG. 4F (the extreme right half), a C-shaped embodiment of a contact plate 4 is represented in comparison with an I-shaped embodiment in FIG. 4H. Again, the contact areas 8 are drawn in black.

It can be seen without any further ado that the respective feed line sections of FIGS. 4A, 4B, 4E and 4F (the upper half) are arranged offset relative to the feed line sections of FIGS. 4C, 4D, 4G and 4H (the lower half). The same also applies to the circuit board hookups 7 which are arranged offset as well.

It can be seen without any further ado that hybrid forms of L-shaped and C-shaped contact plates 6 will also lead to the same result.

It is essential that at least parts of the feed line sections 6 offset to each other such that they are not overlapping.

The near-end crosstalk can be reduced by means of these offset arrangements.

Moreover, the use of contact plates facilitates a stable connection with the corresponding counterpart of the plug-in connector so that—even if this counterpart should be equipped with wires—an improved contact can now be realized since the wire can lie against the contact plate in almost flat fashion, thereby creating an enlarged contact surface.

The invention hereby makes it possible to effectively solve one or several of the aforementioned problems. In particular, the invention solves the current discrepancy which precludes the use of plates for area contacts in view of increased near-end crosstalk that was noticeable previously.

In one embodiment of the invention, the contact field is equipped with eight metallic contacts 4 so that a twisted-pair cabling can be provided for common systems of telecommunication, information transmission and computer technology, for example ISDN and Ethernet cablings. In those cases, the contact field will involve an RJ45 contact field.

The invention makes it possible to provide plug-in connectors that meet the specifications under CAT6a and higher.

In yet another embodiment of the invention, the contact field is equipped with a housing 5 made of insulating material.

This housing 5 serves as receptacle for the contacts and can provide, for example, the metallic contacts 4 as a plug-in array while, on the other hand, it may be quipped with corresponding connecting links for a print mounting on a circuit board 2.

It is particularly preferred that the metallic contact be made as one piece and of a similar type, e.g. L-shaped or C-shaped.

An L-shaped embodiment is represented in FIGS. 2 and 3.

This, like the C-shaped embodiment, proves to be particularly suitable since to this end, only one single punching tool will be required for all contacts and the offset contacts can be realized by a 180° rotation of the arrangement of the L-shaped plate piece.

On the one hand, the L-shaped model achieves an offset arrangement on the circuit board 2 and the overlapping area is minimized as well. Moreover, the L-shape permits a mechanically stable execution of the contacts.

In a preferred manufacturing process, contact plates 4 are installed in a housing 5. The orientation of the contact plates 4 is taken into account during the installation, i.e. in the case of an RJ45 connector, the $3^{rd}$ and $6^{th}$ contacts are installed at a 180° rotation relative to the other contacts.

The installation itself may involve a force fitting. It is understood that other measures for securing the contacts in the housing 5 are usable as well.

Subsequently, the created contact field is connected as a circuit board plug with a structurally prepared circuit board 2. Such a circuit board 2 may also be equipped with additional contact fields 3 for a connection with the wire pairs 11, 12, 13, 14 as well as with additional circuiting, e.g. of balancing networks, fuse elements or the like.

To this end, the circuit board hookup 7 may be executed as pin contacts to be inserted in corresponding soldering openings of a circuit board 2.

In an alternative embodiment, the circuit board hookup 7 may be executed for surface soldering on corresponding soldering pads of a circuit board 2.

What is claimed is:

1. A contact field for a plug-in connection for twisted-pair cabling comprising:

a plurality of metallic contacts interconnectable with a twisted-pair socket, wherein the metallic contacts are formed from contact plates and each metallic contact comprises a feed line section interconnectable with a circuit board;

wherein the plurality of metallic contacts are all of the same shape, are connected to said circuit board, and are arranged adjacent each other;

wherein all but at least two of the plurality of metallic contacts are in the same general orientation such that the feed line sections of the at least two of the plurality of metallic contacts are offset relative to the feed line sections of the other metallic contacts; and wherein the at least two metallic contacts have a 180° orientation relative to the other metallic contacts.

2. The contact field of claim 1, wherein the contact field is defined by eight metallic contacts.

3. The contact field of claim 2, wherein the offset feed line sections of the at least two metallic contacts comprise the third and sixth feed line sections.

4. The contact field of claim 1, wherein the metallic contacts and the respective feed line sections are formed so that they constitute one piece.

5. The contact field of claim 1, wherein the contact field is configured for cooperation with an RJ45 modular connector.

6. The contact field of claim 1, wherein the contact field is suitable to meet the specifications under CAT6a.

7. The contact field of claim 1, further comprising a housing made of insulating material that houses the metallic contacts.

8. The contact field of claim 1, wherein the contact field further comprises connecting links for mounting on said circuit board.

* * * * *